United States Patent [19]

O'Hagan et al.

[11] Patent Number: 4,627,173

[45] Date of Patent: Dec. 9, 1986

[54] FLUID BED HOG FUEL DRYER

[75] Inventors: Michael A. O'Hagan, Cupertino; Richard D. Smith, Palo Alto, both of Calif.

[73] Assignee: The Garrett Corporation, Los Angeles, Calif.

[21] Appl. No.: 483,973

[22] Filed: Apr. 11, 1983

[51] Int. Cl.[4] ..... F26B 3/08

[52] U.S. Cl. ..... 34/10; 34/57 A; 110/224; 110/245; 110/263; 110/347

[58] Field of Search ..... 110/245, 263, 342, 346, 110/347, 224, 225, 227; 122/4 D, 7 R, 7 C, 13 R; 431/7, 170; 34/10, 57 A

[56] References Cited

U.S. PATENT DOCUMENTS

| | | | |
|---|---|---|---|
| 2,638,684 | 5/1953 | Jukkola | 34/9 |
| 3,190,627 | 6/1965 | Goins | 263/21 |
| 3,333,556 | 8/1967 | Jacobovici | 110/227 |
| 3,721,014 | 3/1973 | Voelskow | 34/10 |
| 3,755,912 | 9/1973 | Hamada | 34/10 |
| 3,896,557 | 7/1975 | Seitzer | 34/10 |
| 4,154,581 | 5/1979 | Nack et al. | 110/245 |
| 4,159,682 | 7/1979 | Fitch et al. | 110/245 |
| 4,235,174 | 11/1980 | Spurrell | 110/245 |
| 4,240,364 | 12/1980 | Bryers et al. | 110/263 |
| 4,249,472 | 2/1980 | Mitchell | 110/245 |
| 4,258,005 | 3/1981 | Ito et al. | 110/245 |
| 4,292,742 | 10/1981 | Ekberg | 34/57 A X |
| 4,330,411 | 5/1982 | Florin et al. | 110/346 |
| 4,330,502 | 5/1982 | Engstrom | 110/245 |
| 4,349,969 | 9/1982 | Stewart et al. | 122/4 D |
| 4,355,601 | 10/1982 | Hattiangadi | 122/7 R |
| 4,385,567 | 5/1983 | Voss | 110/227 |
| 4,414,905 | 11/1983 | Beranek et al. | 110/224 |
| 4,535,065 | 8/1985 | Klein et al. | 34/57 A X |

FOREIGN PATENT DOCUMENTS 7631487 5/1977 France .

*Primary Examiner*—Albert J. Makay
*Assistant Examiner*—Steven E. Warner
*Attorney, Agent, or Firm*—J. Henry Muetterties; Albert J. Miller

[57] ABSTRACT

A fluidized bed process and apparatus for uniformly drying particulized wet wood material or waste, commonly called hog fuel, from in excess of 50% moisture content to a 30% level suitable for burning as boiler fuel without generating "blue haze" air pollution typical of conventional rotary dryers. The fluidized bed of this invention is divided into treatment zones by a baffle arrangement. The hog fuel flows substantially horizontally along a circuitous path through the treatment zones. Hot flue gases fluidize the bed of hog fuel and provide necessary drying heat. Fines portions from each zone are entrained by the drying gases and blown out of the vessel just as they achieve the desired level of dryness and before significant blue haze is generated. A cyclone recovers these fines as product. Gas pressure to each treatment zone is adjusted so that only the desired amount of hog fuel is blown from the bed with the balance proceeding to subsequent zones. Regulation of zone gas velocities is achieved by dividing the gas inlet plenum into compartments which coincide with zones requiring adjusted velocities. The dryer may use flue gas from a hog fuel boiler, and in turn dry the hog fuel being burned in that boiler, or it may use the hot gas from an independent combustion source. A particularly attractive arrangement is to mount the fluid bed dryer above a fluid bed combustor burning waste wood in a single vessel.

10 Claims, 2 Drawing Figures

FLUID BED HOG FUEL DRYER

BACKGROUND OF THE INVENTION

1. Field of the Invention

The field of this invention is the drying of wet wood waste having a wide range of particle sizes, such as hog fuel. More particularly, the invention relates to achieving a uniform moisture content without overdrying fines portions of the waste.

2. Description of the Prior Art

Wood wastes are widely used in the forest products industry as boiler fuel to produce steam. Such wastes, commonly called "hog" or "hogged" fuel, are generally a mixture of, for example, bark, wood chips, planer shavings, sawdust and forest residues, including some sand and rocks. Particle size diameters may range from 0.01 inches for sanderdust to several inches for bark. The average particle size for U.S. Pacific Northwest hog fuel is ¾ inch while that of the Southeast averages ⅜ inch. Fine particles, those less than ⅛ inch diameter, comprise about 15–50% of hog fuel.

The moisture content of hog fuel varies widely depending upon such factors as species, weather, production methods and storage patterns. The moisture content for commercial hog fuel may range from 30% to 65% by weight but is normally fired to the boiler at about 45%–55%.

The moisture in hog fuel significantly reduces its value as boiler fuel. At 50% moisture, approximately 12% of the energy of the fuel itself is required to vaporize the moisture. The high flow rate of the water vapor through the boiler decreases the maximum temperature of combustion gases, degrading heat transfer to the steaming tubes of the boiler. Further, the large volume of water vapor in the boiler exhaust produces a sizeable heat loss.

If hog fuel is dried from 50% to 30% moisture content before burning, boiler efficiency is increased 12% and steaming rate would concurrently increase 17%. An ancillary benefit of burning dried hog fuel is a reduction in particulates in the stack gas, due to more complete combustion of the carbon content of the wood. Also, the use of auxiliary fuel such as oil, typically necessary to sustain combustion, may be reduced. Dry hog fuel also offers such significant performance advantages that alternative methods of heat recovery from hog fuel become more practical. For example, firing a fines portion of the wood fuel through a pulverized coal-type suspension burner or producing a fuel gas from the dried wood in a gasifier bed may be reasonably contemplated.

Hog fuel dryers are well known in the forest products industry. Some dryers use flue gas from the wood fired boiler to dry incoming wet hog fuel. Others use hot exhaust gases from some separate combustion device, while a few dryers use steam. Most installations are rotary or cascade-type dryers.

Rotary dryers tumble the hog fuel in a long horizontal cylinder while passing hot gases through the cylinder to perform the drying. The wet hog fuel and hot gases enter at the same end of the dryer. The hog fuel moves through the dryer due to the aerodynamic force of the hot gases and a slight downward tilt of the axis of the dryer. The finest particles of hog fuel are simply blown through the dryer by the hot gas. Larger particles may take from 5 minutes to 30 minutes to transit the dryer.

Hog fuel absorbs moisture easily because of its open porous structure. At 50% moisture content, relatively little surface moisture is evident. As the moisture content increases to 60–65%, surface moisture increases greatly and the hog fuel appears soaking wet. Dryers are typically designed to reduce the average moisture content of the hog fuel to 30–40% before firing in the boiler. If the moisture content is reduced below 30%, dusting occurs resulting in housekeeping problems and fire hazards.

To dry hog fuel to 30–40% moisture content, the moisture must diffuse through the porous structure of the fuel before it can evaporate from the surface. This diffusion rate controls the drying time of hog fuel. Large particles require substantially longer times to dry than small ones because of the difficulty of diffusing moisture to the surface. Drying hog fuel to a truly uniform moisture content is difficult because of the wide variation in particle size.

In a rotary dryer, transit time of the fuel through the dryer is set to achieve an overall average moisture content of, for example, 40%. However, in the typical rotary dryer product, the largest particles will contain substantially more moisture than 40% while the smaller ones will range from perhaps 5 to 15%. A major problem arises from drying the smaller particles to a low moisture content. Inlet hot gases to the dryer range from 450° F. to 1000° F. and the exit gases are usually over 200° F. During the period that water is evaporating from the surface of a particle, it remains near the wet bulb temperature of the gas, 140° F. to 160° F. When the water has evaporated or nearly so, the particle begins to increase in temparature due to heat transfer from the hot gas. As the wood particles increase in temperature above 160° F., they begin to release volatile hydrocarbons. These volatiles, when released to the atmosphere, are air pollutants commonly called "blue haze." Blue haze represents a serious air pollution limitation, substantially restricting the recovery of heat from hog fuel. Blue haze is particularly bothersome when drying wood particles finer than hog fuel, such as sawdust for use in the manufacture of particleboard. For particleboard manufacture, the desired moisture content of the product is 0% rather than the 30% desired for hog fuel and the hot drying gases are typically in the range of 1000° F.

Rotary dryers have other disadvantages. Heat transfer between hot gases and hog fuel is limited because the fuel in the dryer spends the majority of its time laying in the flights of the drum and only a short time falling through the hot gases, where heat transfer principally occurs. Hence, to accomplish the necessary overall heat transfer, rotary dryers tend to be large and require substantial plantsite space.

Cascade dryers entrain and re-entrain the hog fuel in a high volocity upward flow of hot gases directed along the centerline of a vertical cylindrical vessel. Near the top of the cylinder, the hog fuel is directed toward the wall of the vessel while the gas escapes through an outlet at the top. The hog fuel falls downward along the wall and is re-entrained in the jet of hot gases entering at the bottom of the vessel. Dried fuel exits near the wall at a location away from the entrance. The average residence time for the hog fuel in the cascade dryer is two minutes. The smaller fine particles are blown immediately and directly out with the exhausting hot gases.

The cascade dryer overcomes the low heat transfer rate problem of the rotary dryer. Heat transfer rates are excellent at the high relative gas velocities and the hog fuel is exposed to these conditions for a significant portion of its transit time. Cascade dryers are significantly smaller than rotary dryers of equivalent capacity. However, the blue haze problem remains. In fact, the problem is exacerbated because of the high drying rates resulting from the high relative gas velocity and the repeated reintroduction of the drying particles into contact with high temperature inlet gases. In the short residence time of two minutes, the water content of larger particles has little chance to diffuse to the surface of the particle, regardless of how efficiently it is removed from the surface. Hence, in order to meet any specified average exit moisture condition, some particles tend to be overdried.

Fluid or fluidized bed dryers are well known for the high rate of heat transfer between the gas and the fluidized particles as well as between bed particulates and surfaces immersed in the bed. Heat transfer coefficients in fluid beds range to 40 BTU/Hr-Ft$^2$-°F. while similar heat transfer coefficients for a surface exposed to a hot gas stream without the presence of a fluid bed would be perhaps 10 BTU/Hr-Ft$^2$-°F. Heretofore, fluid bed dryers have principally been used for drying homogeneous finely-divided materials whose fluidization characteristics are well known or can be predicted with precision. Granular materials such as activated carbon, coal and plastic beads are routinely dried in fluid bed dryers.

The drying of particulate coal in a fluidized bed is well known, employing, most often, hot combustion gases to fluidize the bed and provide the enthalpy necessary to dry the coal. U.S. Pat. No. 3,755,912 to Hamada, et al., describes a process wherein hot off-gases from a coking oven are used to fluidize and dry a bed of coal. U.S. Pat. No. 3,190,627 to Goins reveals a fluidized bed dryer using a plurality of gas-fired burners to supply hot gas to the fluid bed.

Several processes utilize the combustion of coal to provide the necessary heat for the fluid bed dryer. U.S. Pat. No. 3,896,557 to Seitzer, et al., provides for the collection of coal fines above the fluidizing drying bed and the burning of these fines in a separate combustion chamber to produce products of combustion to fluidize and heat the drying bed.

Jukolla in U.S. Pat. No. 2,638,684 describes drying coal in two fluidized beds arranged in a single vessel. A fines portion of coal is separated from the upper fluidized bed dryer coal product and injected into a lower combustion bed. The lower bed combustion gases provide the drying heat for the coal at sufficient velocity to fluidize the inert solids drying bed and substantially dry and entrain all of the coal fed to the drying bed. The dried, entrained coal is swept from the bed and passes through a series of cyclones which produces a dried coal product and the fines portion for combustion. The Jukkola process requires the use of inert solids fluid beds if coal in excess of 7% moisture is to be dried under stable production conditions. The process would not be suitable for drying hog fuel having a wide particle size range and sensitivity to overdrying.

Difficult waste materials such as sewage and refinery sludges are dried in fluid beds. However, as in Jukkola, these fluid beds are essentially sand beds where the waste material comprises only a small portion of the bed material and does not significantly alter the fluidization characteristics of the inert sand. Fitch, U.S. Pat. No. 4,159,682 teaches drying of sludges in such a sand fluid bed using an inflow of hot sand from a fluid bed combustor to supply the heat. The cooled sand mixed with the dried sludge is transported back to the fluid bed for combustion.

In comparison with coal drying, the drying of wood waste and the like in fluidized beds is a relatively recent art. The nonuniformity of the typical wet wood to be dried has always been the principal problem to be overcome.

Voelskow, U.S. Pat. No. 3,721,014, teaches drying wood particles for particleboard by using two aerodynamic separators employing hot gases to segregate a fine fraction from a coarse fraction. Voelskow recognized the problem of overdrying the fines fraction while attmpting to dry the coarse fraction. Voelskow solved the problem by separating the fractions and drying them separately.

Spurrell in U.S. Pat. No. 4,235,174 teaches the use of a fluid bed combustor burning an oversize waste wood fraction to supply hot gases to a conventional rotary dryer to dry the balance of the hog fuel pile. Output of the dryer is screened into fine and coarse fractions. The fine fraction is burned in a wood-fired boiler in a suspension, pulverized coal type burner while the coarse fraction is burned on the grate. Spurrell does not suggest substituting a fluid bed dryer for drying hog fuel in place of the conventional rotary dryer.

Ide, et al., in French Patent Application No. 76 31487 describes a fluid bed dryer for drying and separating degradable organics for fertilizer composting from biologically inert granular material. The fluid bed dryer has a distributor plate which causes fluidized drying material to move in a spiral path from the center outward. A mechanical arm rotates in the fluid bed to break up lumps of material and to promote smooth fluidization of difficult materials.

SUMMARY OF THE INVENTION

A principal object of this invention is to provide a process and apparatus for drying wet wood waste or hog fuels, using the particular advantages of fluidized bed technologies. For example, the high heat transfer coefficients for the transfer of heat from a hot gas to the wetted surface of wood particles permits considerably smaller dryers in comparison with conventional rotary dryers. Furthermore, the turbulent mixing action of the bed insures uniform heat transfer conditions and breaks up incoming concentrations of wet hog fuel.

The principal purpose and advantage of the invention is that it permits substantially uniform drying of wet wood wastes which have a wide range of particle sizes and drying characteristics which typically heretofore have resulted in overdrying of fines portions of the material.

The moisture content of the fine particles exiting the dryer is approximately the same as the coarse particles exiting the dryer, eliminating a "blue haze" air pollution problem which results from overdrying fines, typical of the rotary or cascade dryers. Uniformity of moisture content between the coarse and fines portions of the wet fuel is an especially important advantage for the fluid bed dryer of this invention.

The fluid bed hog fuel dryer of this invention accomplishes its benefit by providing variable residence times for the different sized wood particles. The fines portions of the feed are quickly carried out of the fluid bed dryer generally leaving, once airborne, within two seconds.

Some of the wet hog fuel particles, as introduced into the bed, are agglomerations of fines held together or onto larger pieces by surface moisture. As the surface moisture is evaporated, these fines are progressively released and are carried from the bed by the cooled gas stream leaving the surface of the bed, without overheating. The large pieces of wood waste remain in the bed for longer periods of time until they are dried to the desired level.

An advantage of the fluid bed dryer of this invention over rotary and cascade dryers its the ability to provide a complete separation between the dried fines and the dried coarse fractions. This is attractive because for certain installations it is desirable to burn the fines in the boiler in air suspension while the coarse fraction is burned on a grate.

A further advantage of the fluid bed dryer of this invention over rotary and cascade dryers is the ability to provide variable residence times for the coarse fraction by a simple adjustment of the level of the bed height during operation. Yet another benefit of the fluid bed dryer is that it produces a coarse fraction of hog fuel essentially free of any residual abrasive materials that would be deleterious to, for example, pulverizing equipment for further processing of the coarse fraction.

In general, the process involves a fluid bed reactor divided by baffling in the fluid bed itself into a plurality of drying zones. The drying zones are subjected to fluidizing gases of such velocity that wet wood material to be treated is fluidized with a fines portion of the feed material in each zone becoming entrained in the gases and departing the bed, and subsequently the reactor vessel, just as those fines achieve a desired level of dryness. The partially dried coarser material in each zone proceeds, for example, substantially horizontally along a circuitous, serpentine path, into a subsequent drying zone. In the subsequent drying zone drying continues with a new fines portion entrained as drying is completed for those particles while the coarser material flows to the next drying zone. The coarsest fraction is finally discharged from the vessel as it achieves the desired level of dryness. The fines portions, as they evolve from the bed, are separated from the fluidizing gases and recovered as product.

The fluidizing gases' velocity is adjusted for each treatment zone so that the only fines portion entrained in such zone is that portion which achieves the desired level of dryness as it leaves the zone or would otherwise be overdried before it could depart the subsequent drying zone. This adjustment is accomplished by dividing a fluidizing gas plenum into compartments with sealing walls that coincide with bed drying zones. Fluidizing velocity into each compartment may then be controlled through dampers or pressure regulators so that the appropriate fluidizing velocity is provided to the drying zones coincident with such compartments.

In drying typical hog fuel or wet wood waste, fine and coarse particles will achieve substantially equal levels of moisture content. A 50–60% moisture content waste is typically dried to a 10–30% moisture content without overdrying fine particles. The finished dry product is suitable for use as boiler fuel. The fines portion may be injected into a boiler through pulverized coal type burners to burn in air suspension. The coarse portion may be pulverized and then burned in suspension or directly fed onto a boiler grate for combustion.

Many heated gases are suitable for fluidizing and drying. Flue gases from almost any combustion process are suitable for drying wet wood waste, providing they have sufficient heat content to accomplish the drying at reasonable flow rates.

In one process and apparatus of this invention a fluid bed combustor is combined with the fluid bed dryer, described above, to provide fluidizing and drying gases. In one arrangement the fluidized bed dryer is mounted above the fluidized bed combustor. The fluidized combustor burns any suitable material evolving gases of sufficient heat and velocity to dry wet hog fuel as described above in the fluid bed dryer. The gases as they evolve from the bed enter internal cyclone separators which remove ash entrained with the gases. A portion of the cooled gases exiting the fluid bed dryer are injected into the combustor cyclone collectors to control the temperature of the gases prior to entering the dryer. In general, it is desirable to reduce gas temperature to less than 1000° F. to prevent overheating of wood. This configuration is particularly attractive because it is compact, requiring relatively small space at the plantsite. Further, it eliminates the expensive hot gas duct that would otherwise be required to join a fluid bed combustor to the dryer.

DESCRIPTION OF THE PREFERRED EMBODIMENTS

Figure 1:
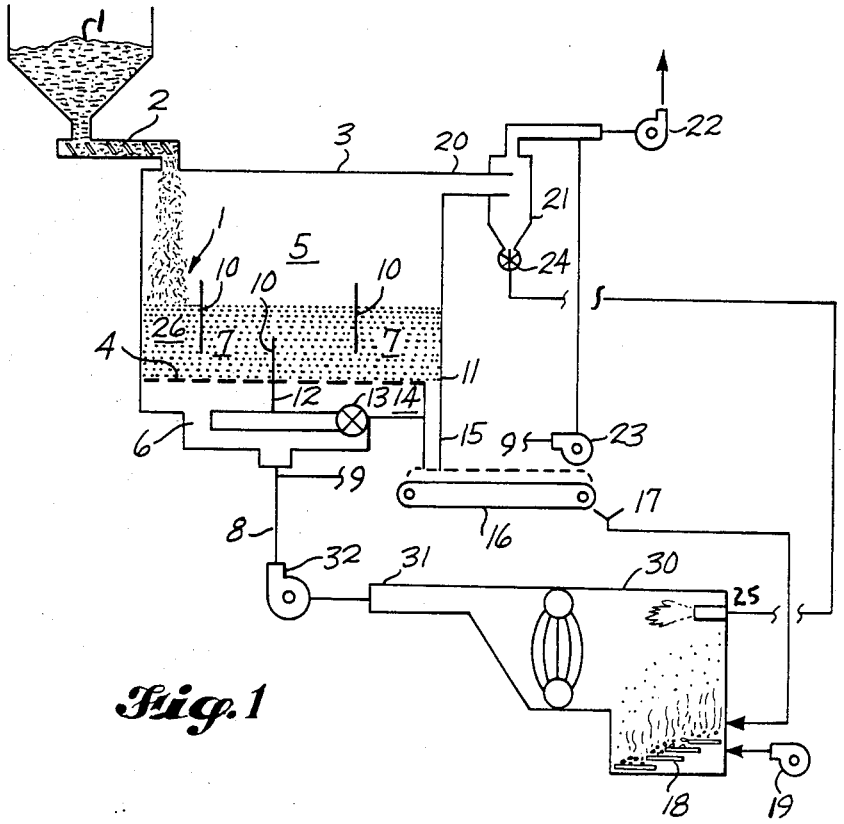
FIG. 1 is a schematic of a process and fluid bed reactor of the invention for predrying hog fuel for boiler fuel using flue gas from the boiler as a source of heat.

Referring to FIG. 1, a process and fluid bed reactor of the invention, specifically designed for drying hog fuel, is depicted. Wet hog fuel 1, up to 65% moisture content, is fed by a worm screw 2 into a vessel 3. A porous screen 4 divides the vessel 3 into upper 5 and lower 6 plenums. The screen 4 supports a fluidized bed 7 in the upper plenum 5 of hog fuel at least two feet deep.

Hot gases 8 are introduced into the lower plenum 6 to fluidize and dry the hog fuel as the gases flow upwardly. The porous screen 4 uniformly distributes the gases into the bed 7. A wood waste boiler 30 provides the hot gases 8, collected at flue 31. These flue gases are typically 400°–600° F. in temperature. A fan 32 acts as an induced draft fan for the boiler 30 and imparts sufficient pressure to the hot flue gases 8 to fluidize the hog fuel fluid bed 7.

The upper plenum 5 adjacent the fluid bed support 4, is divided by baffles 10 designed to create separate drying zones as the hog fuel passes through the dryer. In the rectangular vessel 3 depicted in FIG. 1, the hog fuel flows substantially horizontally from entry zone 26 to discharge 11, being progressively dried in transit. The baffles 10 insure that adequate residence time and mixing of the wet wood occurs in the bed as the drying process proceeds.

The hog fuel becomes considerably lighter in weight as it becomes drier. Hence, less fluidizing gas pressure is required as the fuel moves downstream. In fact, fluidizing gas velocity must be reduced in the later drying zones to prevent excessive entrainment of portions of the fuel that are not dried to the desired level. Thus, seal 12 is provided to divide the lower plenum 6 into compartments that may operate at different gas pressures. Pressure reducing valve 13 reduces gas pressure in plenum compartment 14 so that a uniform fluidization effect overall is maintained. For hog fuel with an average diameter of ¾ inch, at 50% moisture content and a hot gas of 450° F., a minimum superficial gas velocity of 12 feet/second is adequate to provide good fluidization.

The coarsest fraction of dried hog fuel which remains in the fluid bed is discharged through discharge port 11 from the vessel 3, passing through a seal leg 15 onto a product conveyor 16. In this particular arrangement, the dry coarse product is collected at hopper 17 and injected for combustion into boiler 30 onto grate 18, along with combustion air 19.

The cooled drying gases evolving from the fluidized bed 7 and carrying dried hog fuel fines exits the reactor vessel 3 through discharge port 20. The entrained dry hog fuel fines are separated from the drying gases by a cyclone 21. An induced draft fan 22 discharges the spent drying gases. A portion of the gases are drawn by recycle fan 23 for mixing with the hot drying gases entering plenum 6. These recycle gases 9 reduce the oxygen content of the drying gases in the dryer, reducing fire risk and increasing the wet bulb temperature of the hot gases to prevent excessively rapid drying at the surfaces of hog fuel particles.

The dry fines portion of the hog fuel collected by the cyclone 21 is discharged through an airlock 24. The dried fines are injected, combined with air, into boiler 30 through pulverized coal type suspension burners 25.

In operation, hog fuel at 50–65% moisture content is fed into the vessel 3 through the conveyor 2 where it falls onto bed supporting screen 4 into a first drying zone 26. Hot gases fluidize the wet hog fuel, initiating the drying process. The fluidized hog fuel flows in a fluidized state substantially horizontally toward discharge port 11, constrained to follow a somewhat circuitous, serpentine path by baffles 10. The fluidizing gases dry the fluidized hog fuel cooling, for example, from 450° F. to 160°–250° F. in the process. The gases as they leave the bed carry fines portions of hog fuel from each drying zone as the fines dry and become lighter in weight and detach from larger agglomerations. The fines portions of the hog fuel leave the vessel 3, dried to a desired level but without overheating, and are recovered from the existing gases by cyclone 21.

The coarsest portion of the hog fuel exits the bed 7 just as it achieves the desired dryness, substantially at the same level as that achieved by the fines portions. As the hog fuel material travels across the bed it is subjected to reduced fluidizing gas velocities so that the material remains in the bed for a sufficient time to achieve the desired dryness. Seals 12, dividing the lower plenum into compartments, and pressure reducing valve 13, permit lower gas pressures in, for example, the downstream compartment 14 shown in FIG. 1. The reduced pressures result in lower fluidizing velocities in those upper plenum drying zones coincident with reduced pressure compartments.

The rate at which hog fuel is withdrawn from the dryer may be varied by increasing or decreasing the speed of the exit conveyor 16. Such speed adjustments change the depth of the fluid bed and hence, decrease or increase the residence time of the coarse material in the bed. Varying the residence time provides control of the moisture content of the exiting coarse hog fuel, for a fixed flow of hot gas through the dryer.

The hot flue gases are cooled to 160° F.–250° F. in the dryer as moisture is evaporated from the hog fuel. In a typical application, hog fuel would be dried from 50% moisture content to 30% moisture content with 450° F. flue gases, resulting in an improvement in boiler efficiency of 12% and an increase in boiler capacity of 17%.

Figure 2:
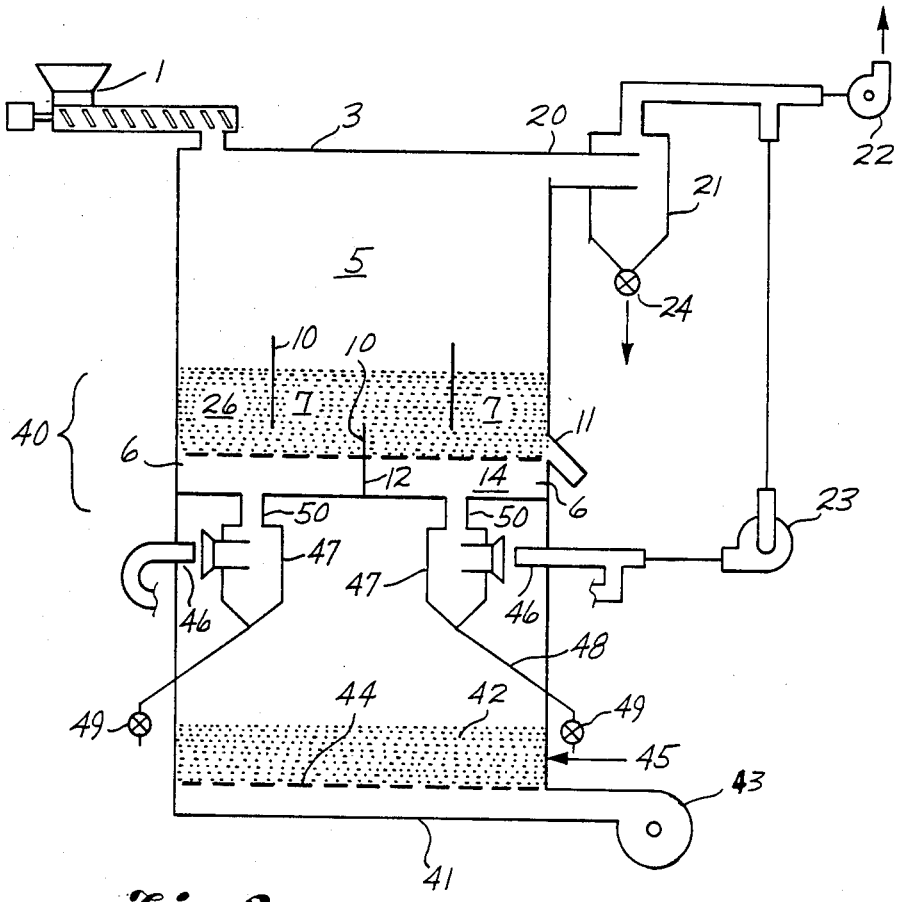
FIG. 2 illustrates a fluid bed hog fuel dryer combined with a fluid bed combustor as a source of drying heat.

FIG. 2 shows the fluid bed dryer of FIG. 1 combined in a single vessel 40 with a fluid bed combustor 41 which provides the hot gases to the lower plenum 6 for fluidizing and drying the wet hog fuel in fluidized bed 7. The combustion fluid bed 42 receives air from a combustion blower 43 through the distributor plate 44. Waste fuels 45 combusted in the bed 42 provide combustion gases nominally at 1500° F., rising from the surface of the fluid bed at approximately 5 feet/second. An inert media, such as sand, is a major component of the fluid bed combuster 41. The waste fuels utilized may be coarse hog fuel, fine hog fuel, fly carbon or any other appropriate waste fuel.

The 1500° F. gases leave the fluid bed combustor passing through cyclones 47. The cyclones remove ash from the gases and transport it out of the reactor through ash discharge lines 48 and air lock valves 49. Recycle gas from the dryer exhaust at 160° F.–250° F. is introduced by an induction fan 23 at the inlet to the cyclones 46 to reduce the temperature of the 1500° F. combustion gas to about 1000° F., increasing the moisture content of the gas to preclude excess surface drying. The recycle gas dilution is also necessary to maintain metal temperatures on the cyclones at about 1000° F. so that low grade stainless steels may be employed for cyclone construction. In many cases the recycle gas is important for reducing oxygen levels to inhibit fire and explosion risk.

The cleaned hot gases at 1000° F. issue from the cyclone exit pipes 50 directly into the lower plenum 6 of the fluid bed dryer where it fluidizes and dries the hog fuel as described earlier. A diverter or reducing valve (not shown) may be introduced to reduce gas velocity in plenum compartment 14, as previously shown in FIG. 1.

EXAMPLE

Run of the mill hog fuel from a Weyerhaeuser Company wood products plant in Klamath Falls, Oreg. was dried in a fluid bed hog fuel dryer as described in FIG. 1 above. The hog fuel was composed largely of Douglas Fir. A screening analysis of the fuel indicated 14% was greater than 1" mesh, 18% was greater than ½" mesh but less than 1" mesh, 41% was greater than number 6 mesh (approximately ⅛") but less than ½" mesh and 28% was less than number 6 mesh. Approximately 28% of the hog fuel would be classified as fines, i.e., less than ⅛" diameter. Prior to the size analysis, the hog fuel had previously been screened through a 2" screen to eliminate oversize pieces which would cause problems in the subscale feeder. This step would not be necessary for commercial scale equipment. The average moisture content of the hog fuel was 50%, with the coarse fraction at 48.1% and the fine fraction at 55.1%.

The fluid bed dryer had a rectangular platform, i.e., supporting gas distributor screen 4 in FIG. 1, with a width of 0.5 feet and a length of 6 feet for a total area of 3 square feet. At the midpoint in the dryer, a baffle extended upwards from the distributor plate 18 inches. Equally spaced on either side of the center baffle were two additional baffles extending downward from above the surface of the fluid bed and terminating 6" above the distributor plate. The bed depth was 3 feet. The plenum chamber was subdivided into two sections below the baffle at the midpoint of the screen and pressure was controlled separately in each plenum to provide uniform fluidization along the flowpath of the dryer.

Hot gases flowed through the dryer at a flow rate of 187 lb/min providing a superficial velocity of 16 feet/-second in the dryer. The inlet temperature of the gases was 378° F. and the exit temperature was 133° F. The wet bulb temperature of the entering gases was 59° F. The pressure drop through the dryer was 12 inches of water. Hog fuel flow rate was 30 lb/min as received with a 50.9% average moisture content (14.7 bone dry lb/min), entering the dryer at 77° F. The coarse fraction of the hog fuel exited the dryer at 123° F. with a moisture content of 33% and the fine fraction exited the dryer with a moisture content of 39%. Approximately 15–20% of the heat in the incoming gas stream was lost through the walls of the pipe and the dryer body.

The fines were blown from the fluid bed by the action of the fluidizing gas and were collected in a baghouse downstream from the dryer. The fines collected in the baghouse represented 42% of the total hog fuel flow. The size distribution of the particles collected in the baghouse was as follows: 2% greater than ¼" mesh; 4% greater than number 6 mesh but less than ¼" mesh; and 94% less than 6 mesh.

The size distribution of the coarse hog fuel exiting the dryer was as follows: 7% greater than 1" mesh; 31% greater than ½" mesh but less than 1" mesh; 50% greater than number 6 mesh and less than ½" mesh; and 3% less than number 6 mesh, indicating that few fines remained with the coarse fraction.

Results of the tests show that the fluid bed hog fuel dryer delivers fines fractions at or exceeding the moisture content of the coarse fraction. Therefore, the fluid bed dryer does not overheat the fines while attempting to dry the coarse fraction to some nominal value and hence, avoids the generation of blue haze from overheated small particles. This feature is particularly important if sawdust or chips are being dried, for example, to near 0% moisture for particle board using 1000° F. hot gas.

Analysis of the above results confirms that the drying process for hog fuel at 51% moisture content or below is diffusion controlled. That is, the diffusion of water from the interior of the particle to the surface of the particle controls the rate at which the overall drying occurs. Fluid beds provide excellent heat transfer to the surfaces of the particles in the bed so it is reasonable that the diffusion mechanism would be rate controlling. The diffusion effect will be somewhat ameliorated at higher moisture levels where substantial amounts of surface water are present. Dryer designs based completely on a diffusion model, derived from tests at moisture ratios of 51% and below, will therefore tend to be conservative.

For drying processes that are diffusion controlled, the following relationship applies:

$$Q_r = \frac{1}{1 + Bt}$$

where $$Q_r = \frac{\text{moisture content of dried material, lb/dry lb}}{\text{moisture of wet material, lb/dry lb}},$$

t=average residence time in the dryer, and

B=diffusion constant

For the fluid bed hog fuel dryer, "average residence time" is defined as the volumetric hog fuel flow rate/-volume of the fluid bed. This defintion ignores the residence times of the fines which spend only a short (and unmeasurable) time in the bed and are subsequently blown out.

The "diffusion constant" was calculated for several tests using the previously defined hog fuel with a 3 foot bed depth over a range of inlet temperatures from 300° F. to 450° F. The average value for B was 0.09 1/minutes. Actual values will be perhaps 15% larger as heat losses were not considered in correlating the data. This means an actual dryer will be somewhat smaller than that calculated using the correlation. Using this figure, the bed size can be calculated for a given drying requirement and hog fuel throughput.

According to the test data, a full scale dryer for drying 10 bone dry tons/hr. of hog fuel from 50% moisture content (wet basis) to 34% moisture content using 450° F. stack gas would be 95 $ft^2$ in area and have a gas pressure drop of 12 IWC. This dryer would require less than half the plantsite space of a conventional rotary dryer of equivalent capacity.

The process and apparatus of this invention are suitable for drying any particulate wood material. Its most advantageous use is in drying a material such as hog fuel that has a wide range of particle sizes, such that there is danger of overdrying a finer portion of the material. While the wet wood material to be dried by this invention is termed wood waste, it is to be understood that there is no limitation in the invention to merely drying wastes.

We claim:

1. A process for drying, in a fluid bed reactor, wet wood waste having a range of particle sizes to a substantially uniform moisture content, comprising:

feeding said wood waste into a first fluid bed treating zone;

fluidizing said wood waste in said first zone with a hot gas of sufficient velocity whereby the finest particle size portion of said waste is entrained in said gas and departs the fluid bed as said fines portion achieves a desired moisture content; establishing said desired moisture content of said material to avoid significant distillation of volatiles from said wood;

transporting said remaining wood waste in a fluidized state, now partially dried, to subsequent fluid bed treating zones;

adjusting the velocity of said fluidizing hot gases in each subsequent zone whereby the finest portion of the remaining wood waste in each zone is entrained and departs the fluid bed as each fines portion in each zone achieves the desired moisture content with the remaining partially dried material in a zone proceeding to the next treating zone;

discharging the final remaining portion of the wood waste from the fluid bed as it reaches the desired moisture content, and;

separating and collecting, simultaneously with the above steps, the entrained fines portion of wood waste from the fluidizing gas as it departs the fluid bed.

2. The process of claim 1 wherein said wet wood waste initially comprises in excess of 50% moisture content by weight.

3. The process of claim 1 wherein the step of establishing said desired moisture content of said material comprises the steps of:

passing said material through at least two drying zones; and removing said desired material with said desired moisture content from each of the zones.

4. The process of claim 1 wherein said drying process is limited to drying wood waste to 10–30% moisture content by weight.

5. The process of claim 4 wherein the dried wet wood waste is utilized by:

mixing the dried fines and coarse material leaving the fluid bed dryer, and;

combusting the dried mixture in a wood waste heat recovery boiler.

6. The process of claim 4 wherein said dried wood waste is utilized by:

feeding the collected dried wood fines from the fluid bed for combustion in air suspension in a wood fired boiler, and;

feeding the dried coarse wood from the fluid bed for combustion onto a grate of a wood fired boiler.

7. The process of claim 1 wherein drying is achieved by fluidizing said material with a hot gas having a temperature of less than 1000° F.

8. The process of claim 7 wherein said hot gases are gaseous products of combustion.

9. The process of claim 8 wherein said hot drying gases are obtained by:

combusting a portion of said wet wood in a fluid bed combuster, and;

directing the resulting hot gaseous products of combustion into said fluid bed dryer drying zones.

10. The process of claim 8 wherein said hot gases are flue gases from a wood fired boiler.

* * * * *